US006416216B1

(12) United States Patent
Haughey

(10) Patent No.: US 6,416,216 B1
(45) Date of Patent: Jul. 9, 2002

(54) EVENT CLOCK

(76) Inventor: Reid J. Haughey, 1228 King Row Ave., Carbondale, CO (US) 81623

( * ) Notice: Subject to any disclaimer, the term of this patent is extended or adjusted under 35 U.S.C. 154(b) by 0 days.

(21) Appl. No.: 09/330,523

(22) Filed: Jun. 11, 1999

(51) Int. Cl.[7] ..... G04B 19/06
(52) U.S. Cl. ..... 368/89; 368/107
(58) Field of Search ..... 368/10, 70–103, 368/281, 282

(56) References Cited

U.S. PATENT DOCUMENTS 2,305,283 A * 12/1942 Theilkas ..... 368/228
D146,757 S * 5/1947 Webb ..... 368/228
2,647,330 A * 8/1953 Ford ..... 368/228
2,853,804 A * 9/1958 Bengeyfield ..... 368/228
3,967,389 A 7/1976 Brooks
4,124,945 A 11/1978 Totten
4,208,870 A * 6/1980 Cullom ..... 368/228
5,044,961 A 9/1991 Bruskewitz

* cited by examiner

*Primary Examiner*—Bernard Roskoski
(74) *Attorney, Agent, or Firm*—Dorsey & Whitney LLP

(57) ABSTRACT

The present invention provides a convenient, effective, and interactive system to aid children or others in managing and understanding the concept of time and in remembering scheduled events. The present event clock visually demonstrates the time during which at least one predetermined event is scheduled to occur. Generally, the event clock includes a timing mechanism, an indicator operatively connected to the timing mechanism, and at least one (and preferably several) event marker(s). Each event marker visually symbolizes (through pictures, words, or otherwise) a scheduled event and is disposed in relation to the indicator such that the indicator provides a signal during the time the event is scheduled to occur.

19 Claims, 6 Drawing Sheets

EVENT CLOCK

FIELD OF THE INVENTION

The present invention relates generally to clocks and visual aids for use in time management, teaching time concepts, organization, and scheduling.

BACKGROUND OF THE INVENTION

Many people have difficulty keeping track of time and managing their schedules. This is especially true of children, who may not be able to understand the concept of time, read a clock, or keep track of how long daily activities take. Accordingly, parents are often forced to encourage children constantly to hurry or remind them repeatedly about upcoming events. Such constant reminders are tedious for parents and frustrating to children, who usually prefer not to be told what to do. Additionally, such reminders do not support or increase the child's understanding of time.

Because smaller children (and some adults) cannot tell time, traditional clocks are ineffective aids to help them manage their time and schedules. Calendars or other planners that keep track of scheduled events according to the time and date they are to occur are ineffective for similar reasons. Moreover, most children are easily distracted and have little sense for the concept of how long activities take. As such, even children who can tell time are unlikely to check a calendar, remember specific times for scheduled events or even remember to look at a clock when engaged in daily activities. Thus, children have difficulty transitioning from one activity to another (i.e., understanding the progress of a current activity and preparing for the next one).

What is needed is a system to visually aid in teaching the concept of time, managing time, and remembering scheduled events that can be used by children and others who have difficulty keeping track of time using traditional clocks or planners.

What is needed is a system to visually aid in managing time and remembering scheduled events that is interactive and interesting to children and others.

SUMMARY OF THE INVENTION

The present invention provides a convenient, effective, and interactive system to aid children or others for both managing time and remembering scheduled events. The present event clock visually demonstrates the time during which at least one predetermined event is scheduled to occur. Generally, the event clock includes a timing mechanism, an indicator operatively connected to the timing mechanism, and at least one event marker. The event marker is disposed in relation to the indicator such that the indicator provides a signal during the time the event is scheduled to occur.

Preferably, the event clock is provided with numerous event markers that are removably affixed to the face of the event clock and can be rearranged depending on the individual user's schedule. In addition, the indicator preferably provides a signal that also demonstrates the passage of time during the scheduled event (such as a pointer sweeping across the event marker). Each event marker visually symbolizes (through pictures, words, or otherwise) a scheduled event. During the scheduled time, the indicator signals (such as by pointing at the appropriate event marker) that the particular event is scheduled to occur.

The present invention has several advantages over typical clocks. For example, a child or other user need not be able to tell time or remember a schedule to use the present invention. Rather, the present invention signals the user directly at the time of a scheduled event and visually demonstrates the passage of time during a scheduled event. In fact, the event clock of the present invention provides parents an opportunity to teach children about timekeeping and scheduling while also allowing children to keep track of their own schedules in the interim.

The present event clock is also interactive and interesting to children. Children (either alone or with the help of an adult) can arrange and rearrange appropriate event markers on the front face of the event clock to correspond to changing schedules. The event markers can be made from a variety of materials and removably affixed to the front face of the event clock by any number of means, including magnets, Velcro, snaps, etc. In addition, scheduled events can be depicted on the event markers in a variety of ways. Premade event markers depicting certain events can be purchased along with the event clock, and/or markers can be hand-made or altered with decals, markers, paints, etc. to personalize the event clock. Further, several event markers can be used to signal a single event (such as by having multiple consecutive event markers of the same color). Extra event markers can be stored within the event clock itself, and the event clock preferably includes a handle and finger holes so that it is easily portable by a child or other user.

DETAILED DESCRIPTION OF THE INVENTION

Figure 1:
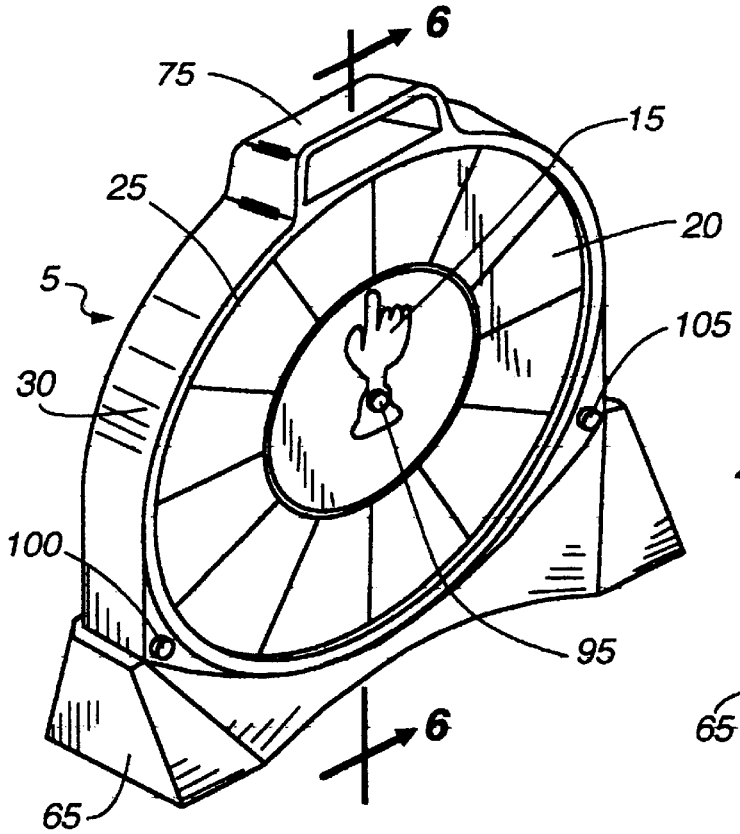
FIG. 1 is an isometric view illustrating one embodiment of the event clock of the present invention and its associated stand.
Figure 2:
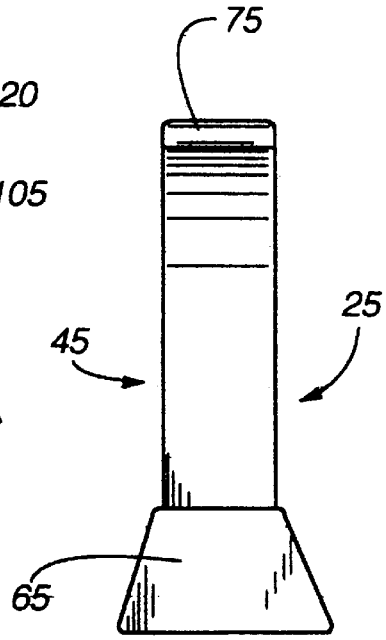
FIG. 2 is a left-side elevation of the event clock and associated stand illustrated in FIG. 1.

The event clock 5 of the present invention provides a versatile visual aid for children or others who need help with understanding the concept of time or remembering scheduled events. The present event clock 5 visually demonstrates the time during which at least one predetermined event is scheduled to occur and includes a timing mechanism 10, an indicator 15 operatively connected to the timing mechanism 10, and at least one event marker 20. The event marker 20 is disposed in relation to the indicator 15 such that the indicator 15 signals during the scheduled time that the particular event is to occur. Preferably, the event clock is provided with numerous event markers 20 that are removably affixed to the front face 25 of the event clock 5 and can be rearranged depending on the individual user's schedule.

Event markers 20 visually symbolize (through pictures, words, or otherwise) a scheduled event. Depending on a the length of a scheduled event, a group of event markers 20 can represent a single event. For example, three red event markers placed in succession may represent the time allotted for a single event even though only the middle event marker 20 includes a visual depiction of the event. At the scheduled time the indicator 15 signals (such as by pointing at the beginning of the appropriate event marker(s) 20) that the particular event is scheduled to begin at that time. Then, during the allotted time for that event, indicator 15 signals the progression of time by sweeping across the appropriate event marker(s). Among other things, the shape of the event clock 5, orientation and nature of the event markers 20, method of signaling by the indicator 15, and type and speed of the timing mechanism 10 employed are all variable without departing from the scope of the present invention.

Figure 3:
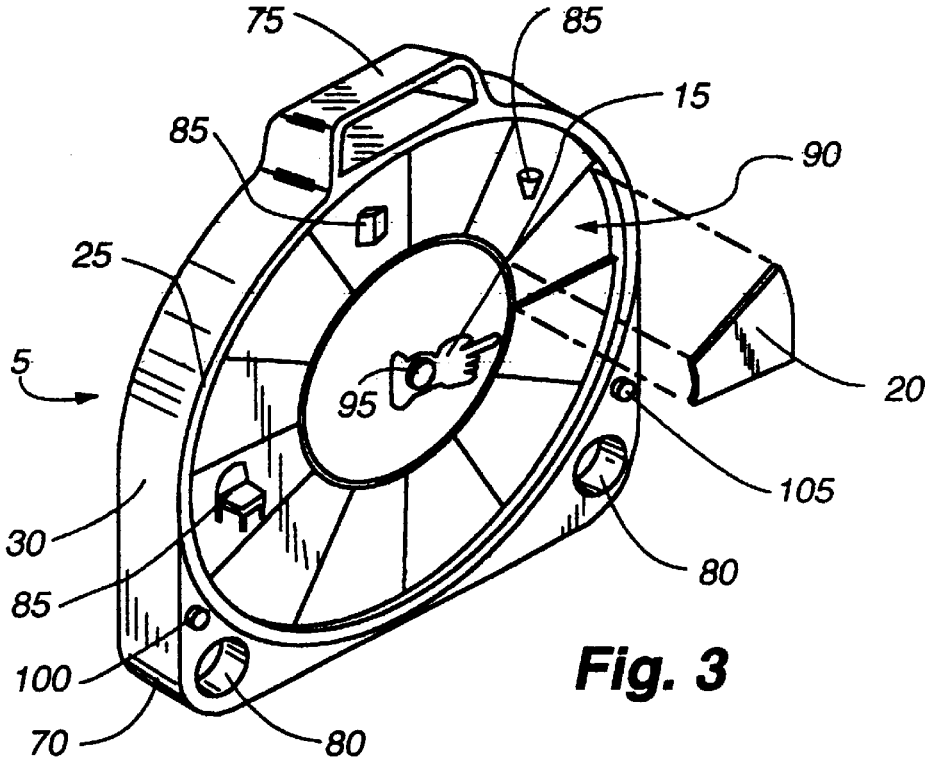
FIG. 3 is an isometric, partially-exploded view of the event clock illustrated in FIG. 1 without its associated stand.

FIGS. 1–6 illustrate various isometric views of a first preferred embodiment of the present invention. The event clock 5 has a hollow housing 30 with radial reinforcing ribs 35, an internal structure 40 for supporting the timing mechanism 10, a substantially round front face 25, a substantially round back face 45 composed of two access doors 50 & 55, and a peripheral wall 60. The event clock 5 is also provided with a stand 65 in which the housing 30 can be cradled. As shown most clearly in FIGS. 2 and 4, the stand 65 provides a stable base for the housing; however, as shown in FIG. 3, the housing 30 is preferably formed with a squared-off base 70 such that it can stand independently as well. The event clock 5 is also provided with a handle 75 and finger holes 80 for portability. Around the periphery of the front face 25 and surrounding the indicator 15, event markers 20 including event symbols 85 are affixed to the front face 25 to symbolize scheduled events. As shown in FIG. 3, the event markers 20 are disposed in event marker slots 90, which are preferably provided as depressions in the front face 25 of housing 30. The indicator 15 is fixed to a timing mechanism 10 through an indicator axle 95. The timing mechanism 10 drives the indicator axle 95 and the indicator 15 so that they rotate in unison at a constant speed. Optionally, the event clock 5 also includes a start button 100 and a stop button 105 to control the rotation of the indicator axle 95.

Figure 5:
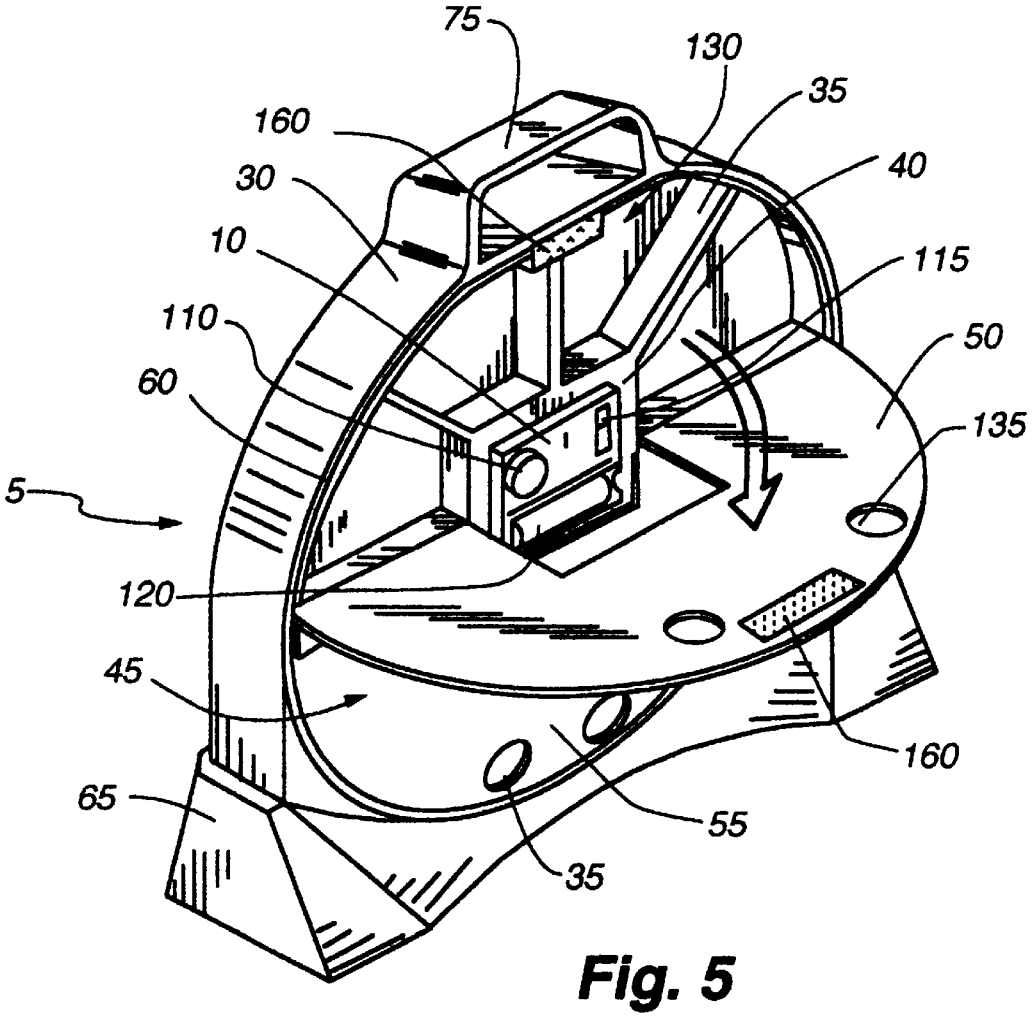
FIG. 5 is an isometric view looking at the rear of the clock and associated stand illustrated in FIG. 1.
Figure 6:
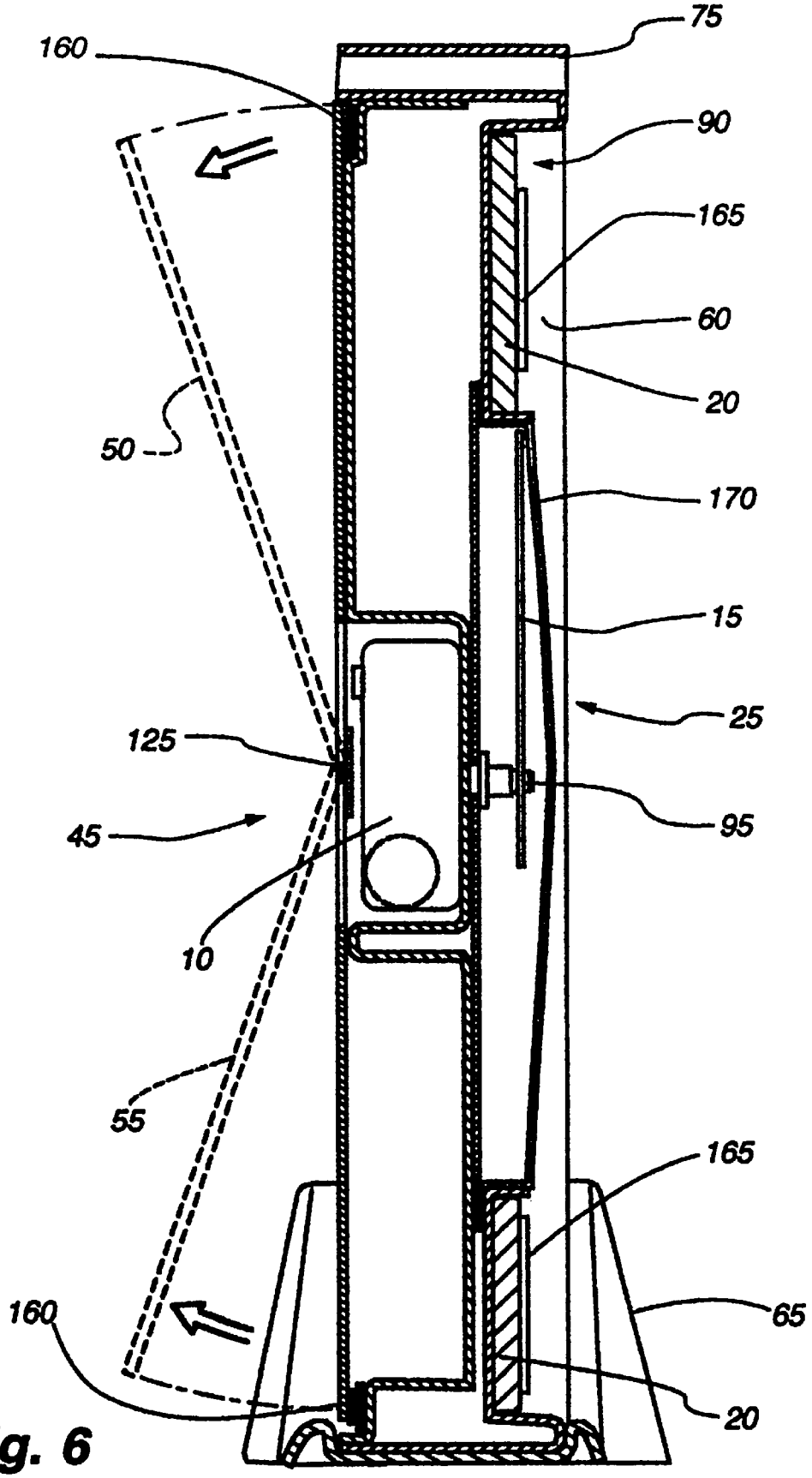
FIG. 6 is an enlarged section taken along line 6—6 of FIG. 1 with rear access doors illustrated in an open position with dashed lines.

As seen most clearly in FIGS. 5 and 6, the timing mechanism 10 includes a set wheel 110, an on/off switch 115, and a battery 120. The back face 45 of the event clock 5 is formed by a top access door 50 and a bottom access door 55, which are mounted with a hinge 125 to diametrically aligned, horizontally disposed ones of the reinforcing ribs 35 so that each access door 50 & 55 can be pivoted into an open position (shown in dashed lines in FIG. 6) to provide access to event marker storage slots 130. The access door grips 135 are provided as holes in each of the top and bottom access doors 50 & 55.

In operation, the event clock 5 pictured in FIGS. 1–6 works as follows. The timing mechanism 10 drives the indicator axle 95 to rotate at a constant speed. The indicator 15, which is connected to the indicator axle 95, thus sweeps around the front face 25 of event clock 5, pointing sequentially to the series of event markers 20 positioned around the perimeter of the front face 25. The battery 120 provides power to the timing mechanism 10 when the switch 115 is in the "on" position. Optionally, the event clock 5 can be provided with the start button 100 and the stop button 105 as alternative means of controlling power to the timing mechanism 10. Otherwise, the indicator 15 sweeps around the front face 25 whenever the switch 115 is in the "on" position.

The event markers 20 are affixed in the event marker slots 90 around the perimeter of the front face 25 of housing 30. The event markers 20 can be held in place by a variety of means, including, without limitation, Velcro®, magnets, snaps, tongue-in-groove connectors, etc. Preferably, however, the event markers 20 are removably affixed to the front face 25 of housing 30 such that the event markers 20 can be moved to different positions around the front face 25 depending on when the event symbolized by that event marker 20 is scheduled to occur. This visual depiction of scheduled events can be used as an aid in both remembering scheduled events and in teaching the concept of time.

For example, one use for the event clock 5 is to help a child through his morning routine. An event marker 20 might symbolize breakfast time for the child by including an event symbol 85 that is a picture of a cereal bowl. The next consecutive event marker 20 might include an event symbol 85 that is a picture of a toothbrush. Another event marker 20 might then include an event symbol 85 that is a picture of a school bus. In this manner, the child can look at the event clock 5 during breakfast and see (by how far the indicator 15 has progressed across the cereal-bowl event marker 20) approximately how much longer he has before he must start brushing his teeth, etc. If the child's morning routine varies for some reason from day to day, the event markers 20 can be exchanged and/or moved to different positions around the front face 25 to accommodate those variations in time. Similarly, a school teacher can use the present invention to visually demonstrate how long particular activities will take during the school day.

The size and placement of the event markers 20 will depend on several variables including the speed of the timing mechanism 10 and the precision with which it is desired to mark scheduled events. For example, if the timing mechanism 10 is a typical clock motor, such that the indicator 15 sweeps around the front face 25 of the housing 30 once every hour (like the minute hand on a clock), then putting twelve event markers 20 around the perimeter of the front face 25 of the housing 30 will allow the user to mark up to one event per five minutes. Similarly, six event markers 20 of twice the size illustrated could be used to mark scheduled events every ten minutes.

In addition, it is anticipated that not every five minutes, ten minutes, or other time period will be marked by a scheduled event. Therefore, blank event markers 20 (with no event symbols 85) are provided to place in event marker slots 90 where no event is scheduled. Moreover, it is recognized that some events will take longer than others. The present event clock 5 can be adapted to account for these variations in event duration. For example, assume that the size of the event markers 20 and speed of the timing mechanism 10 driving indicator 15 are such that each event marker 20 represents five minutes. If a particular event is scheduled to last fifteen minutes, three event markers 20 bearing the same event symbol 85 can be used. Or three event markers of the same color, only one of which bears an event symbol 85, can be used to depict the fifteen minute duration for that event. Other manners of depicting events of varying duration using the present event clock 5 will be evident to those skilled in the art.

Importantly, the event clock 5 of the present invention is not limited to using typical clock mechanisms. Rather, any motor capable of driving the indicator axle 95 at a constant speed may be used, including a motor that would cause the indicator 15 to turn at a faster or slower rate than a typical clock. In fact, the timing mechanism 10 can comprise a variable-speed motor having different settings to accommodate different applications of the present invention. For example, if the user wishes to depict events that occur over a two-hour period of time, the timing mechanism might be set to complete one rotation every two hours (i.e., half the speed of a typical clock motor driving the minute hand on a clock).

In some settings, it will be preferred that a typical clock timing mechanism 10 is employed because it will make it easier for the user of the event clock 5 to determine where to position event markers 20 for scheduled events. In addition, employing a typical clock timing mechanism 10 will facilitate using the event clock 5 to teach children to tell time on a traditional clock. The indicator 15 will act just as the minute hand on a traditional clock. In addition, using event markers 20 that represent standard time increments (such as five minutes each) helps give children a perspective on how long an hour, or half hour, etc. takes to pass. As such, the event clock 5 of the present invention provides a perfect opportunity for parents and/or teachers to teach children how to tell time and accurately schedule and transition between events within particular time periods.

The event markers 20 may be constructed from any suitable material, including plastic, fabrics, etc. The most suitable material for an event marker 20 in a particular embodiment will depend, in part, on the means by which the event marker 20 is to be affixed to the front face of the housing. For example, if the event markers 20 are to be held in place by Velcro®, plastic event markers 20 will not work (unless a separate strip of Velcro® is attached to the event marker 20).

In addition, depending on how a user is to depict or symbolize scheduled events on the event marker 20, different materials should be employed. Some event markers 20 might be prefabricated with event symbols 85 already on them; however, the event clock 5 is made more interactive and interesting to children if event symbols 85 can be added to event markers 20 by the user. For example, a user may wish to identify scheduled events on an event marker 20 using a decal affixed to the event marker 20, in which case the surface of the event marker 20 should be suitable to receive such decals. In other embodiments, however, a user may wish to draw directly on an event marker 20, in which case the event marker 20 should be made of a material that would accept ink or paint without smearing. In fact, if erasable ink and a reusable surface were provided, the event markers 20 need not even be detachable. In that event, the event markers 20 could be provided simply as immovable sections of the front face 25 and the user could draw and/or redraw event symbols 85 in the appropriate section(s). It is preferred, however, that the event markers 20 be removably affixed to the front face 25 so they can be moved without having to redraw the event symbol(s) 85 every time the user's schedule changes. The options are innumerable for attaching the event markers 20 and for creating event symbols 85 thereon, and the examples set forth herein are not limiting to the scope of the invention.

Figure 4:
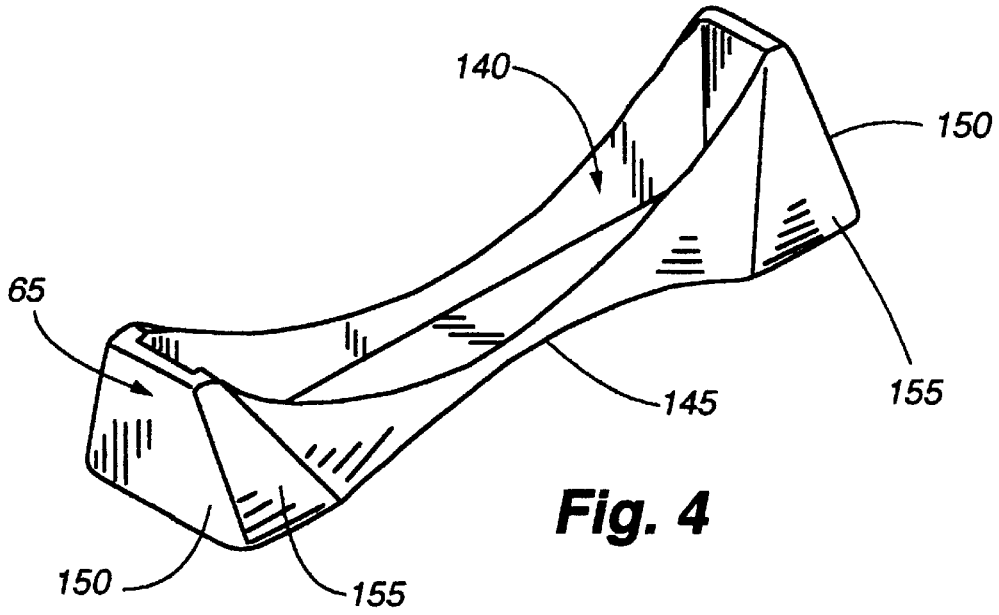
FIG. 4 is an isometric view of the associated stand illustrated in FIG. 1 without the event clock of the present invention.

As shown most clearly in FIG. 3, the event clock 5 of the present invention is preferably made portable by the addition of a handle 75 to the peripheral wall 60, and optionally, finger holes 80. This is so that a child or other user can carry the event clock 5 of the present invention as they play or do other activities around the house or elsewhere. The handle 75 can be formed as an integral part of the housing 30 or attached to the housing 30 by any suitable means. The squared-off base 70 of the housing 30 allows the event clock 5 to stand upright whether or not cradled in the stand 65. However, as is shown in FIG. 4, the stand 65 provides a more stable base for the event clock 5 when it is cradled inside. The stand 65, itself, can be constructed in any of a variety of ways. The particular construction depicted in FIG. 4 is merely exemplary.

The stand 65 illustrated in FIG. 4 has an inner cavity 140 that is open at the top and adapted to receive the squared-off base 70 of the event clock. It is preferred that the base 70 of the event clock fit fairly snugly within the inner cavity 140 to prevent tipping, but it should not fit so tightly as to impede the easy placement and removal of the event clock 5 within the stand 65. The walls of the stand 65 are shorter near the longitudinal center 145 of the stand to permit full view of the front face 25 of the event clock 5 when cradled by the stand 65. The longitudinal ends 150 of the stand 65, however, are higher and include side walls 155 that slope outwardly from top to bottom to provide greater stability.

It is anticipated that a typical user will purchase or create a significant number of event markers 20, but not use all of those event markers 20 at the same time. As such, the event clock 5 of the present invention provides storage for additional event markers 20. As shown in FIG. 5, and as mentioned previously, the event clock 5 of the present invention includes top and bottom access doors 50 & 55 that define the back face 45 of the event clock 5. These access doors 50 & 55 provide entry to the event marker storage slots 130, which preferably correspond in shape and orientation to the event marker slots 90 on the front face 25 of the event clock 5. The storage slots are formed by the reinforcing ribs 35 that extend between the front and back faces 25 & 45 of the housing 30 and that emanate radially outwardly from the timing mechanism 10 to the peripheral wall 60 of the housing 30. Access door grips 135 are also preferably provided for ease of access to the event marker storage slots 130. The top and bottom access doors 50 & 55 may be secured shut by any reasonable closure, including, as shown, a Velcro® closure 160.

FIG. 6 illustrates a cross-sectional view of the event clock 5 along line 6—6 of FIG. 1. As shown in FIG. 6, the housing 30 preferably fits snugly within the stand 65 to discourage the event clock 5 from tipping. Event markers 20 fit within the event marker slots 90 formed within the housing 30 and are removably affixed there in the manner previously discussed. In the particular embodiment shown, decals 165 are provided on the face of the event markers 20 to illustrate scheduled events; however, as discussed, events can be, depicted on the event markers numerable other ways.

As clearly shown in FIG. 6, the indicator 15 is fixed to the indicator axle 95, which is driven at a constant speed by the timing mechanism 10. The indicator 15 preferably rotates within a protective indicator case 170 so that children or other users do not accidentally break it. markers must be changed because the indicator 15 will have rotated fully around the front face 25. Because the indicator in this embodiment moves linearly, the problem of an indicator 205 retracing its path after a set period of time is avoided.

Figure 7:
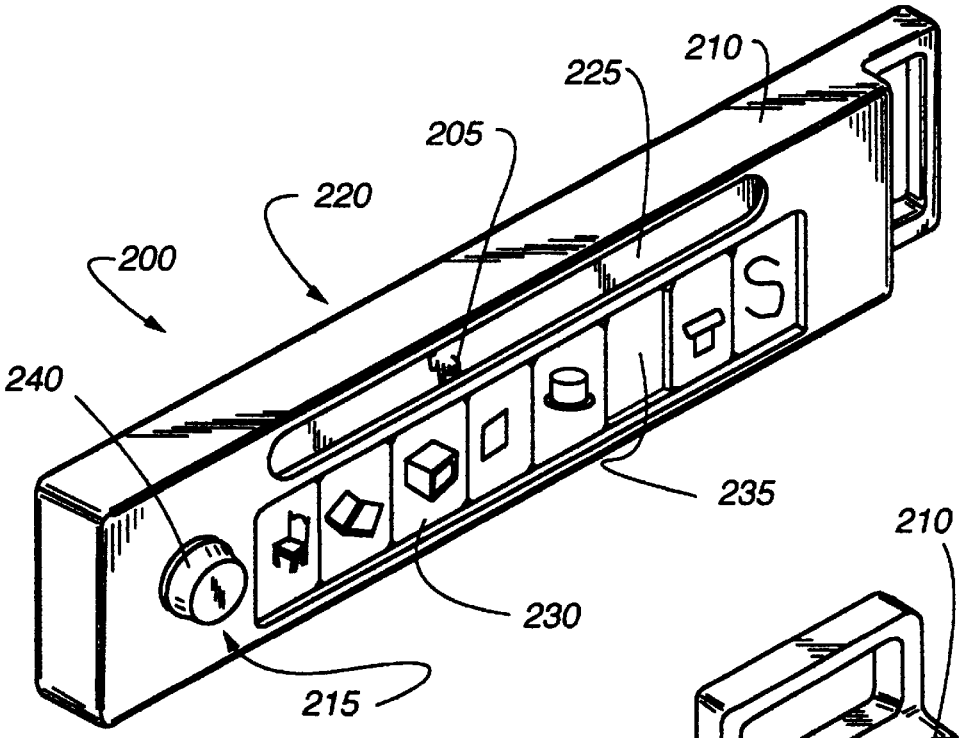
FIG. 7 is an isometric view of a second embodiment of the present invention.
Figure 8:
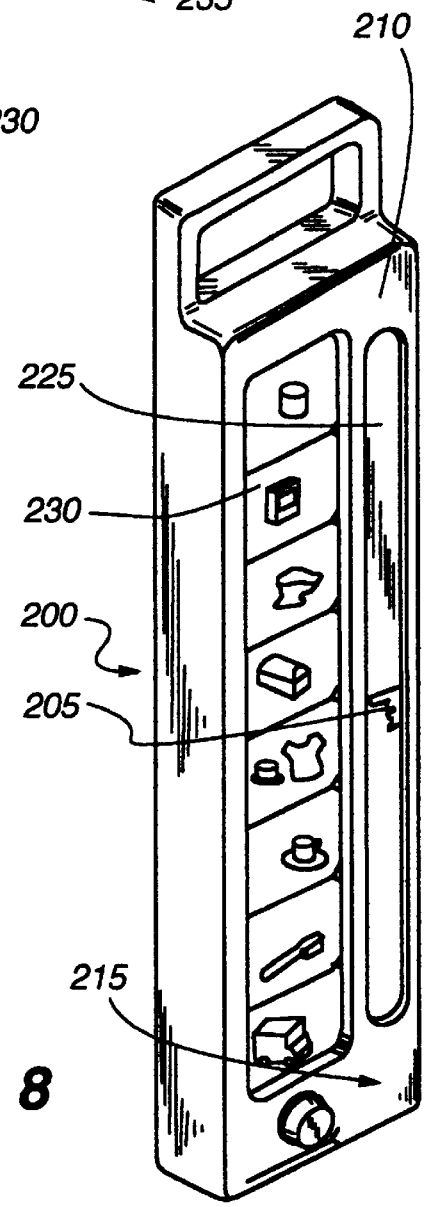
FIG. 8 is an isometric view of the invention as illustrated in FIG. 7 but being rotated 90 degrees to stand on its end.

FIG. 8 illustrates the event clock 200 of FIG. 7 set on its end. This arrangement includes all of the same elements as the embodiment shown in FIG. 7; however, in this arrangement the event markers 230 are oriented to be most easily seen when the housing 210 is vertically disposed.

FIGS. 9–14 illustrate in greater detail the operation of the embodiments shown in FIGS. 7 and 8. FIGS. 9–14 are specifically directed to details of the event clock 200 as shown in FIG. 7, but it will be appreciated that the arrangement shown in FIG. 8 will operate in essentially the same manner.

Figure 9:
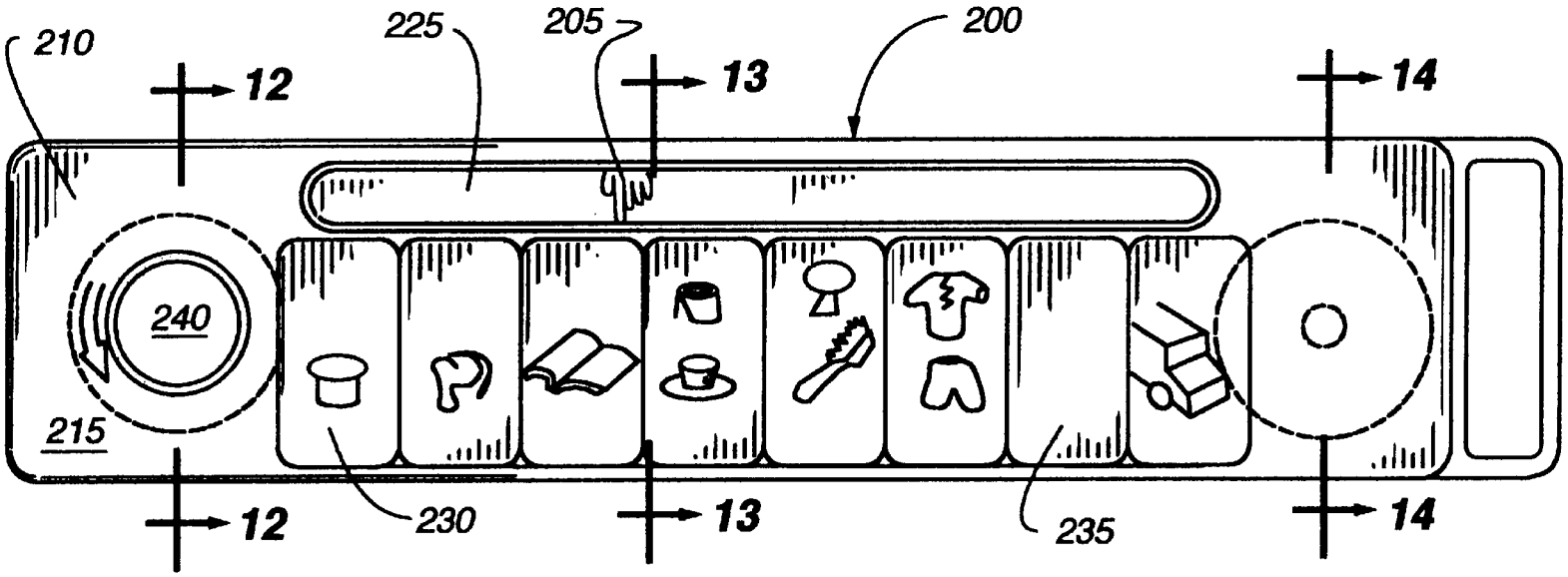
FIG. 9 is a front elevation of the embodiment illustrated in FIG. 7.

FIG. 9 illustrates in greater detail the front face 215 of the event clock 200. Event markers 230 are disposed in event marker slots 235 in the same manner as described in relation to FIGS. 1–6. Again, these event markers 230 can be created in any of the variety of manners or from the variety of materials previously described. In addition, as previously discussed, the number of event markers 230 provided on the front face 215 can be varied depending on the speed at which the indicator 205 moves, the number of events desired to be marked, and the total time period to be scheduled. The front face 215 is also provided with a view window 225 through which the indicator 205 can be seen. In addition, the set knob 240 protrudes out from the front face 215 and can be used to control manually the position of the indicator 205. The orientation of the indicator 15 can be set or reset by the set wheel 110 on the back of the timing mechanism. However, optionally, the indicator case 170 can be eliminated, and the user can reset the indicator 15 directly simply by rotating it to its desired position. The indicator 15 can be set to start at any position so long as event markers 20 are placed in appropriate event marker slots 90 so that the indicator 15 sweeps across the appropriate event markers 20 during scheduled times.

FIG. 7 illustrates another preferred embodiment of the event clock 200 of the present invention. In this embodiment, the indicator 205 moves along a linear, rather than circular, path. A housing 210 is provided with substantially rectangular front and back faces 215 & 220. An indicator is visible through a view window 225, which is provided in the front face 215 of housing 210. Event markers 230 are disposed in linearly aligned event marker slots 235 positioned adjacent the view window 225. The indicator 205 can be moved to any starting position via a set knob 240. When activated, the indicator 205 in this embodiment moves at a constant speed from left to right (as oriented in FIG. 7), thereby pointing to a series of event markers 230 symbolizing scheduled events. In the embodiment shown in FIG. 7, the event markers 230 are oriented so as to be most easily seen when the housing 210 is horizontally disposed.

Figure 10:
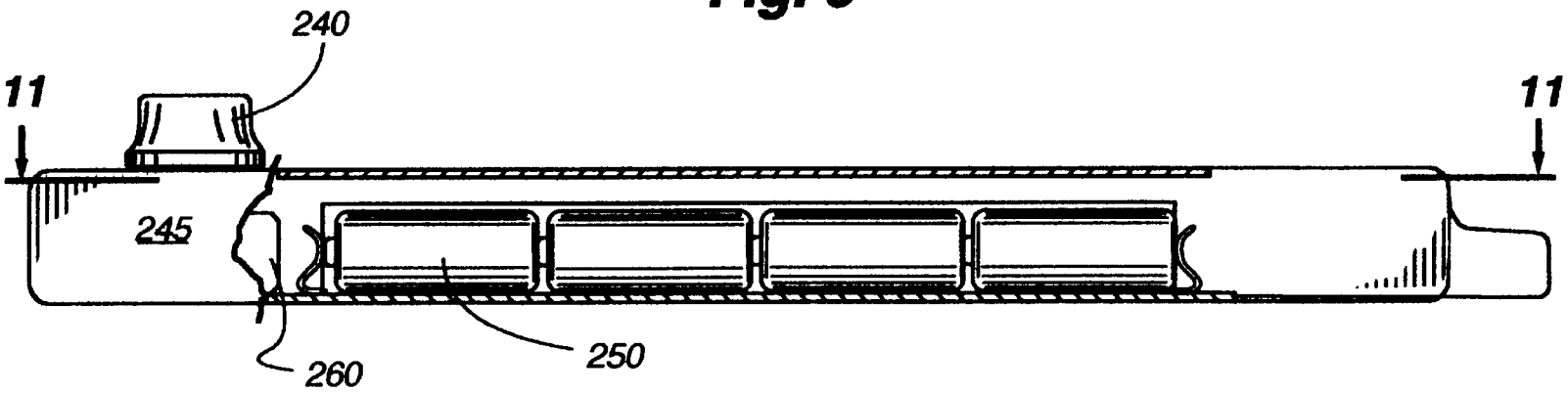
FIG. 10 is a bottom plan view of the embodiment of FIG. 7 with parts broken away for clarity.

This embodiment is particularly useful when it is desired to depict events over a nonstandard period of time. As discussed, if a typical clock motor is used in the embodiment illustrated in FIGS. 1–6, events can only be depicted over a one-hour span before the event FIG. 10 illustrates a partial cut-away view of the bottom face 245 of the event clock 200 shown in FIG. 9. As shown, the event clock is preferably provided with several batteries 250, which power a timing mechanism 260 enclosed within the housing 210. As described further herein, the timing mechanism 260 drives the movement of the indicator 205.

Figure 11:
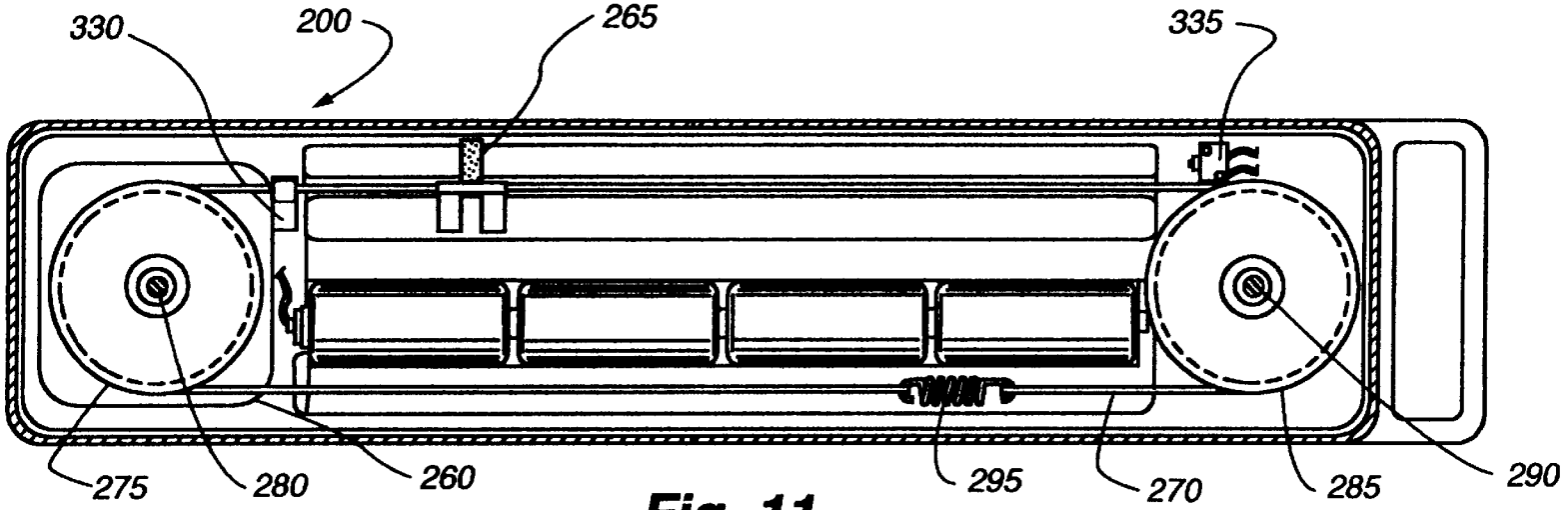
FIG. 11 is a section taken along line 11—11 of FIG. 10.

FIG. 11 is a cross-section of the event clock 200 along line 11—11 of FIG. 10. As shown, the indicator 205 is supported by an indicator support 265, which is attached to a flexible indicator line 270 (or cord). The indicator line 270 is looped around a set knob wheel 275, which is driven by the same set knob axle 280 as the set knob 240, and a return wheel 285, which is connected to a separate return wheel axle 290. The ends of the indicator line 270 are connected by a spring 295, which provides tension on the indicator line 270. In addition, as shown more clearly in FIGS. 12 and 14, each of the set knob wheel 275 and the return wheel 285 include a groove in its outer wall. Both wheels 275 & 285 are preferably constructed to be thicker at their perimeters to provide sufficient space in which to create the grooves 300. The indicator line 270 sits within these grooves 300 and is held in place by the tension on the indicator line 270 created by the spring 295. The flexible indicator line 270 can be made from any suitable material, including a nylon line with a plastic coating similar to fly-fishing line.

Figure 13:
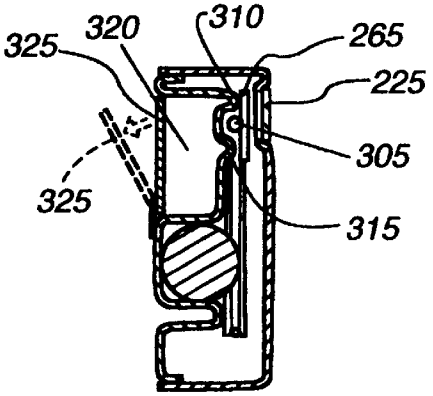
FIG. 13 is a section taken along line 13—13 of FIG. 9.
Figure 14:
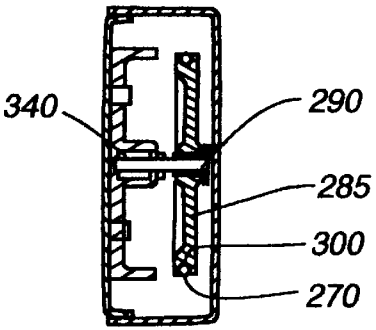
FIG. 14 is a section taken along line 14—14 of FIG. 9.
Figure 12:
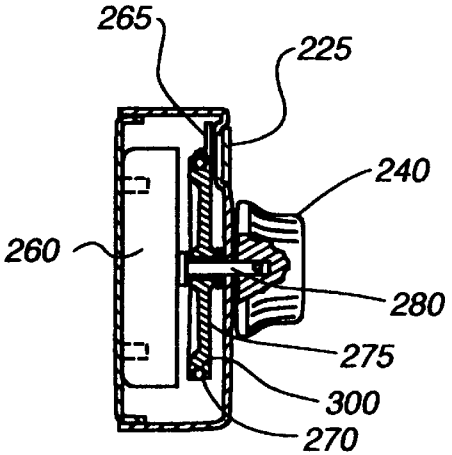
FIG. 12 is a section taken along line 12—12 of FIG. 9.

As shown in FIG. 13, the indicator line 270 is threaded through a guide 305 in the back of the indicator support 265. The indicator support 265 is connected to the indicator line 270 by any suitable means, such as crimping or adhesive. The indicator support 265 thus moves in conjunction with the indicator line 270. In addition, the internal walls of the event clock housing are preferably constructed to create top and bottom stabilizing ridges 310 & 315. These stabilizing ridges 310 & 315, in conjunction with the view window 225, physically preclude the indicator support 265 and the indicator 205 from unwanted rotation that might otherwise cause the indicator 205 to be difficult to see through the view window 225. In addition, it is preferred that the internal walls of the event clock housing be constructed to create a storage area 320, accessible by a storage door 325, suitable for storing extra event markers 230. The particular placement of elements within the event clock housing 210 is subject to numerous design choices and should not be limiting of the present invention.

The event clock 200 shown in FIG. 11 also includes a stop 330, which physically impedes movement of the indicator support 265 beyond the stop 330 in the direction of the timing mechanism 260. On the other end of the event clock 200, a switch 335 impedes the movement of the indicator support 265 in the direction of the return wheel 285 and cuts off power from the batteries 250 to the timing mechanism 260 whenever the indicator support 265 contacts the switch 335.

In operation, power is provided to the timing mechanism 260 by batteries 250 whenever the indicator support 265 is not in contact with the switch 335. When provided with power, the timing mechanism 260 drives the set knob axle 280 to rotate at a constant speed. The set knob axle 280 is fixedly connected to both the set knob 240 and the set knob wheel 275. As the set knob wheel 275 rotates at a constant speed, the indicator line 270 is pulled around within the groove 300 of the set knob wheel 275, thereby causing the indicator support 265 and the indicator 205 to move linearly. The movement of the indicator line 270 also causes the return wheel 285 to rotate in the same direction as the set knob wheel 275. The return wheel 285 is fixedly connected to a return wheel axle 290, which freely rotates within a chamber 340. It does not matter which direction the timing mechanism 260 causes the indicator 205 to move; however, it is preferred that the indicator 205 move left-to-right (towards the return wheel 285) as most users would expect movement in that direction.

As the indicator 205 moves linearly towards the return wheel 285, it points sequentially to the event markers 230 positioned on the front face 215 of the event clock 200. Here again, the event markers 230 should be positioned relative to the starting point of the indicator 205 such that the indicator 205 sweeps across the event marker 230 during the time scheduled for the event symbolized by that event marker 230. In addition, as described in relation to the embodiment shown in FIGS. 1–6, a variable-speed timing mechanism 260 can be used to accommodate variations in the time period a user wishes to schedule using the present invention.

When the indicator 205 reaches the end of the view window 225, the indicator support 265 contacts the switch 335, which causes power to the timing mechanism 260 to be cut off, thereby stopping the movement of the indicator 205. At that point, or at any point during the operation of the event clock 200, the indicator 205 can be reset to a desired position by manually turning the set knob 240.

Turning the set knob 240 simultaneously turns the set knob axle 280 and the set knob wheel 275, thereby causing the indicator 205 to move linearly. In the embodiment shown in FIG. 9, turning the set knob 240 in the direction of the arrow will cause the indicator 205 to move linearly from right to left, thereby allowing a reset of the indicator 205 after it has run to the end of the view window 225. Once contact between the set knob indicator 265 and the switch 335 is broken, the timing mechanism 260 will again be activated. In some instances, a user may wish to move the indicator 205 ahead rather than back. For that reason, it is preferred that a timing mechanism 260 is used that is geared to allow manual rotation of the set knob axle 280 in either direction.

It will be understood by those skilled in the art that the exact configuration of the event clock described herein can be varied in many ways without departing from the scope of the present invention. For example, in lieu of or in addition to the pointing indicator depicted in the figures, one of ordinary skill in the art could also use a series of lights positioned behind the event markers 20 to indicate the time for scheduled events. If the event markers 20 and the front face of the housing are translucent, such lights could be positioned behind each event marker 20 slot to back-light the event markers 20 at the appropriate times for scheduled events. In addition, in the embodiments illustrated in FIGS. 7–14, one of ordinary skill in the art could devise an "automatic return" mechanism to cause the indicator to return to its starting point when the indicator reached the end of the view window. Accordingly, the scope of the present invention should not be limited except by the following claims.

I claim:

1. An event clock for visually demonstrating the time during which at least one predetermined event is scheduled to occur, comprising:

an indicator;

a timing mechanism including a variable-speed motor, operatively connected to the indicator and adapted to control the indicator for at least a particular duration of time; and at least a first event marker, visually symbolizing a first event scheduled to occur during a first preset time and disposed in relation to the indicator such that the indicator signals during the first preset time that the first scheduled event is to occur;

wherein the particular duration of time during which the timing mechanism controls the indicator is longer than the first preset time.

2. The event clock of claim 1, further comprising: a housing having a first face to which at least the first event marker is affixed.

3. The event clock of claim 2, wherein the first face is substantially round.

4. The event clock of claim 2, wherein the first face is substantially rectangular.

5. The event clock of claim 2, wherein at least the first event marker is removably affixed to the first face of the housing and can be reaffixed in different positions on the first face of the housing depending on the particular time during which the first scheduled event is to occur.

6. The event clock of claim 1, wherein the indicator signals the progression of time during which a scheduled event is to occur by sweeping across the event marker symbolizing that scheduled event.

7. The event clock of claim 2, further comprising:

a handle, connected to the housing, to facilitate carrying of the event clock.

8. The event clock of claim 2, further comprising:

a stand adapted to receive the housing and maintain the event clock in an upright position.

9. The event clock of claim 3, wherein the indicator is juxtaposed with the first face and at least part of the indicator moves along a substantially circular path.

10. The event clock of claim 4, wherein the indicator is juxtaposed with the first face and the indicator moves along a substantially linear path.

11. The event clock of claim 2, further comprising:

at least a second event marker, symbolizing a second event scheduled for a second preset time, affixed to the first face and disposed in relation to the indicator such that the indicator signals during the second preset time that the second scheduled event is to occur.

12. The event clock of claim 11, wherein both the first and second event markers are removably affixed to the first face of the housing and can be reaffixed in different positions on the first face of the housing depending on the first and second preset times the first and second scheduled events are to occur.

13. The event clock of claim 2, wherein the housing includes at least one compartment in which additional event markers can be stored.

14. The event clock in claim 1, wherein said at least a first event marker can be adapted to represent events of varying time lengths.

15. An event clock for visually demonstrating the time during which at least two predetermined events are scheduled to occur, comprising:

a timing mechanism including a variable-speed motor;

an indicator, operatively connected to the timing mechanism;

a first event marker, visually symbolizing a first event scheduled for a first preset time and disposed in relation to the indicator such that the indicator signals during the first preset time that the first scheduled event is to occur; and a second event marker, visually symbolizing a second event scheduled for a second preset time and disposed in relation to the indicator such that the indicator signals during the second preset time that the second scheduled event is to occur;

wherein the second event marker is disposed so as to be visible even during the first preset time.

16. The event clock of claim 15, wherein the first and second event markers are disposed in relation to the indicator such that the indicator automatically signals that the second scheduled event is to occur after signaling that the first scheduled event is to occur.

17. The event clock of claim 15, further comprising a housing having a front face, wherein the first and second event markers are removably affixed to the front face of the housing and can be reaffixed in different positions on the first face of the housing depending on the preset times during which the first and second scheduled events are to occur.

18. The event clock of claim 15, wherein the indicator signals the progression of time during which a scheduled event is to occur by sweeping across the event marker symbolizing that scheduled event.

19. The event clock in claim 15, wherein said first event marker and said second event marker can be adapted to represent events of varying time lengths.

* * * * *